US009516962B2

(12) United States Patent
Mertzel

(10) Patent No.: US 9,516,962 B2
(45) Date of Patent: Dec. 13, 2016

(54) BUTTER DISH WITH ROTATABLE LID

(71) Applicant: Joelle Mertzel, Porter Ranch, CA (US)

(72) Inventor: Joelle Mertzel, Porter Ranch, CA (US)

( * ) Notice: Subject to any disclaimer, the term of this patent is extended or adjusted under 35 U.S.C. 154(b) by 31 days.

(21) Appl. No.: 14/635,359

(22) Filed: Mar. 2, 2015

(65) Prior Publication Data

US 2016/0255974 A1 Sep. 8, 2016

(51) Int. Cl.

| | |
|---|---|
| ***B65D 43/14*** | (2006.01) |
| ***A47G 19/26*** | (2006.01) |
| ***B65D 25/28*** | (2006.01) |
| ***B65D 51/24*** | (2006.01) |
| ***B65D 85/74*** | (2006.01) |

(52) U.S. Cl.

CPC ..... *A47G 19/26* (2013.01); *B65D 25/28* (2013.01); *B65D 43/14* (2013.01); *B65D 51/24* (2013.01); *B65D 85/74* (2013.01); *B65D 2525/283* (2013.01); *B65D 2543/00833* (2013.01)

(58) Field of Classification Search

CPC ..... A47G 19/26; B65D 51/24; B65D 43/14; B65D 25/28; B65D 85/74; B65D 2543/00833; B65D 2525/283; B65D 43/165; B65D 43/164

USPC ..... 220/810, 845, 846, 212, 212.5, 254.1,220/254.3, 254.4, 256.1, 259.1, 676; D7/502

See application file for complete search history.

(56) References Cited

U.S. PATENT DOCUMENTS

| | | | | |
|---|---|---|---|---|
| D192,870 | S | 5/1962 | Schwartz | |
| D259,690 | S | 6/1981 | Fetzer | |
| 6,872,920 | B2 * | 3/2005 | Haber | A47J 36/06 219/430 |
| 7,293,846 | B2 * | 11/2007 | Collins | F25D 23/04 220/661 |
| 8,960,441 | B1 * | 2/2015 | Marquis | A47G 19/26 206/525 |
| 2011/0084071 | A1 * | 4/2011 | Gundersen | A47G 19/26 220/252 |

OTHER PUBLICATIONS

Butter dish with spreader, Google search-butter dish-images.
Butter dish with oval plate, Google search-butter dish-images.
Butter dish with roll top, Google search-butter dish-images.

* cited by examiner

*Primary Examiner* — Robert J Hicks
*Assistant Examiner* — Kareen Thomas
(74) *Attorney, Agent, or Firm* — Joseph Golant

(57) ABSTRACT

A butter dish having a rotatable lid that opens to an obtuse angle to give wide access to butter stored on a base cover by the lid. The butter dish includes the base, a rear wall defining a rotational axis located above the base and toward the rear of the base and the lid is mounted to the rear wall and rotates between closed and opened positions.

20 Claims, 7 Drawing Sheets

11a

BUTTER DISH WITH ROTATABLE LID

FIELD OF THE INVENTION

The present invention relates to a butter dish, and more particularly, to a butter dish with a rotatable lid that encloses butter on the dish when closed and provides enhanced access to the butter when opened.

BACKGROUND OF THE INVENTION

Butter dishes are well known containers for sticks or blocks of butter. Typically, the butter dish includes a dish or plate for supporting the butter and a removable cover that is lifted off the dish to provide access to the butter. Several problems exist with such butter dishes including close spacing between the cover and the butter and handling of the cover once it is lifted off the plate. The close spacing means that the cover often comes into contact with the butter when moving away from the dish and/or when the cover is returned to the plate. This translates to greasy butter being deposited on the cover and then transferred to the region between the cover and the plate when the two are brought together again. Having butter between the cover and the plate ruins the quality of the seal of the cover to the plate.

Greasy butter may also be transferred to the countertop or table where the cover is set down during the process of removing a pat of butter and applying the butter to another item, such as a slice of bread. To avoid leaving greasy butter on a countertop a user often attempts to set the cover upside down on the countertop, but this is often difficult because a handle for the cover may be on top of the cover so that the cover is not stable and may fall to the floor and break; also handling of the cover is difficult because it is difficult to grab an upside down cover.

Another problem is that butter left between the cover and the plate softens if left at room temperature but will then fuse the cover to the plate when placed in a refrigerator. When next used the cover will be difficult to open or remove and may even be dangerous as a consumer struggles with the cover.

Another type of butter dish, one with a hinged or roll top, tends to be somewhat complicated structurally and limiting in that such dishes only open to 90° and thus they constrict access to the butter by a user using a butter spreader. With such a restricted opening butter may accidently be smeared on the closure, the lip of a glass plate or of a stand.

Patents have been granted over the years on butter dishes, such as U.S. Pat. No. D259,690 issued in 1981 to Buchsteiner for a design of a "Dish With Hinged Cover." The Buchsteiner patent purports to disclose a base, a curved back wall and a matching curved cover hinged to only open to 90°. Another such patent was granted to Schwartz, U.S. Pat. No. D192,870 issued in 1962 purporting to show a dish and a removable cover.

The invention described below in detail addresses these and other deficiencies of the prior art. The features and advantages of the present invention will be explained in, or become apparent from, the following summary and description of the preferred embodiment considered together with the accompanying drawings.

SUMMARY OF THE INVENTION

In accordance with the present application, an advantageous method and apparatus are disclosed. The apparatus takes the form of a sleek and stylish butter dish that is easy to use, simply constructed and opens widely enough to avoid, when used, butter smearing parts of the butter dish. In addition to bcing stylish, easy to use and simply constructed, the butter dish disclosed herein is structurally robust, relatively inexpensive and provides easy access to the stored butter because the closure opens to more than 90°. The butter dish is also designed to be scaled up or down as a function of the shape of the block of butter to be enclosed or of the size of opening desired and yet, the butter dish is still relatively compact.

Briefly summarized, the present invention relates to a butter dish with a rotatable lid including a base having a bottom surface for supporting the butter dish on a support surface and a top planar surface spaced away from the bottom surface for supporting butter, a rear wall connected to the base for forming part of an enclosure and defining a rotational axis, the rotational axis being spaced from the top surface of the base and located near a rear of the base, and a lid connected to the rear wall and forming another part of the enclosure over the base and over any butter on the top planar surface of the base, the lid having a bottom edge and a rear opening with a rear edge, and the lid being constructed and dimensioned to be rotatable around the rotational axis between a first position where the rear edge of the lid cooperates with the rear wall to close the enclosure and the lower edge of the lid is supported by the top planar surface of the base, and a second position where the rear and lower edges of the lid have rotated to about the same obtuse angle relative to the top planar surface of the base.

The invention also relates to a method for making a butter dish including the steps of forming a base having a top surface and a spaced apart bottom surface, forming a rear wall extending from the top surface of the base, forming an axis of rotation on the rear wall above the top surface of the base and near a rear of the base, and connecting a lid to the rear wall, the lid being movable around the axis of rotation between a closed position where the lid, the rear wall and the top surface form an enclosure for butter on the top surface of the base and an opened position where a lower edge of the lid rotates to an obtuse angle and a rear edge of the lid moves away from the rear wall wherein the lid rests on a butter dish support surface to enable easy access to the butter.

BRIEF DESCRIPTION OF THE DRAWINGS

For the purpose of facilitating an understanding of the invention, the accompanying drawings and detailed description illustrate a preferred embodiment thereof, from which the invention, its structure, its construction and operation, its processes, and many related advantages may be readily understood and appreciated.

DESCRIPTION OF THE PREFERRED EMBODIMENT

Figure 1:
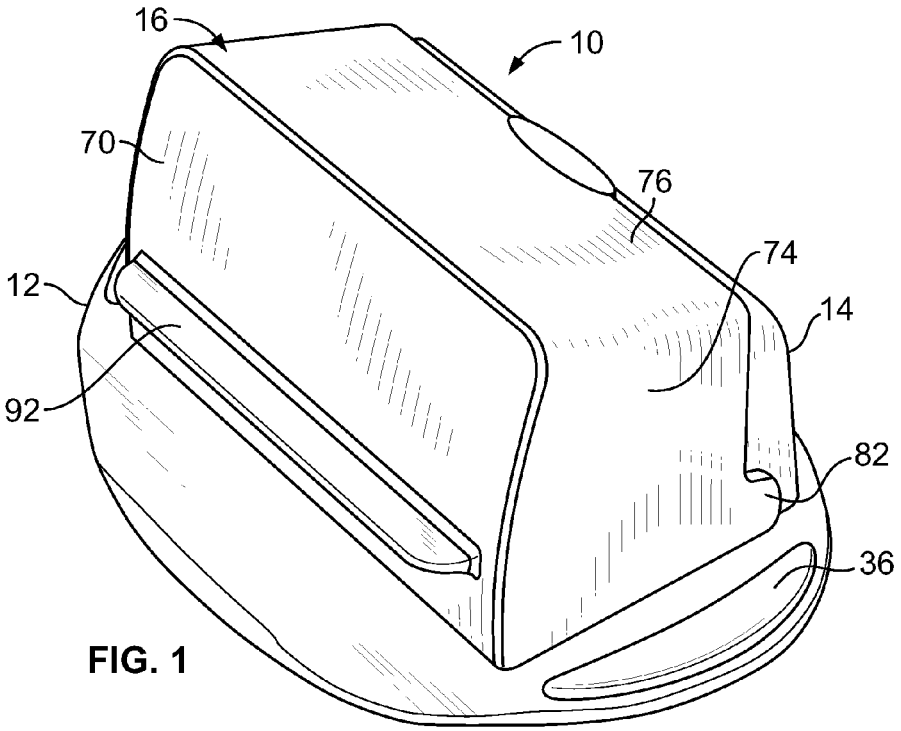
FIG. 1 is an isometric view of a preferred embodiment of the present invention illustrating the front and side of a butter dish apparatus in the closed position.

The following description is provided to enable those skilled in the art to make and use the described embodiment set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Referring to FIGS. 1-4, there is illustrated a butter dish 10 with a rotatable cover, closure or lid. The butter dish 10 includes a stylized base, dish or plate 12, a rear wall 14 and a stylized rotatable lid 16. The butter dish 10 is shown in a first or closed position in FIGS. 1 and 2, and in a second or opened position in FIG. 3, where a block of butter 18, drawn in phantom lines, and a butter knife or spreader 20 are also shown.

The base 12, FIGS. 5-8, may have a generally oval shape in plan view (see FIG. 8) with a top surface 22 having a completely flat or planar region 24 for receiving butter and a front recessed region 26 for storing the butter spreader 20. The top surface 22 may also include two spaced apart slots 30, 32 positioned toward the rear of the top surface 22 for mounting the rear wall 14. Near the ends along the long dimension of the oval base 12 are two attached sidc grips or pads 34, 36 to facilitate holding and handling of the butter dish 10. Spaced a predetermined distance from the top surface 22 of the base 12 is a bottom surface in the form of an oval shaped rim 40. The rim 40 may include a non-skid surface or be covered by a non-skid element. The rim 40 is designed to support the butter dish 10 on a support surface 42, FIG. 4, drawn in dotted lines, such as a kitchen countertop or a table. As will be explained below, the dimension between the top and bottom surfaces 22, 40 is chosen along with other dimensions to ensure that the lid 16 opens to an obtuse angle regardless of the size of the block of butter enclosed in the butter dish. The recessed region 26 of the base may include a front lip portion 44 for restraining the butter spreader 20. The front lip 44 is located at an opposite end of the minor axis of the base from a base rear end 46.

In the alternative, the base 12 may have a different geometric shape in plan view, such as being more rectangular or square, or trapezoidal, or even circular or a blending of these or other shapes. The bottom rim 40 may also have a different geometric shape, such as a rectangle, a square or a circle, or simply a flat surface. Or, other shapes may be used as long as those shapes of the bottom surface of the base provide that the base and, therefore the butter dish, is stable when placed on the support surface. Also in the alternative, the top surface 22 may be coated, roughened or grooved to better restrain the butter from easily moving around the top surface, or a removable plate or butter holder may be used on the top surface, if desired. The top surface may also include a recessed region for the butter, if desired.

Figure 2:
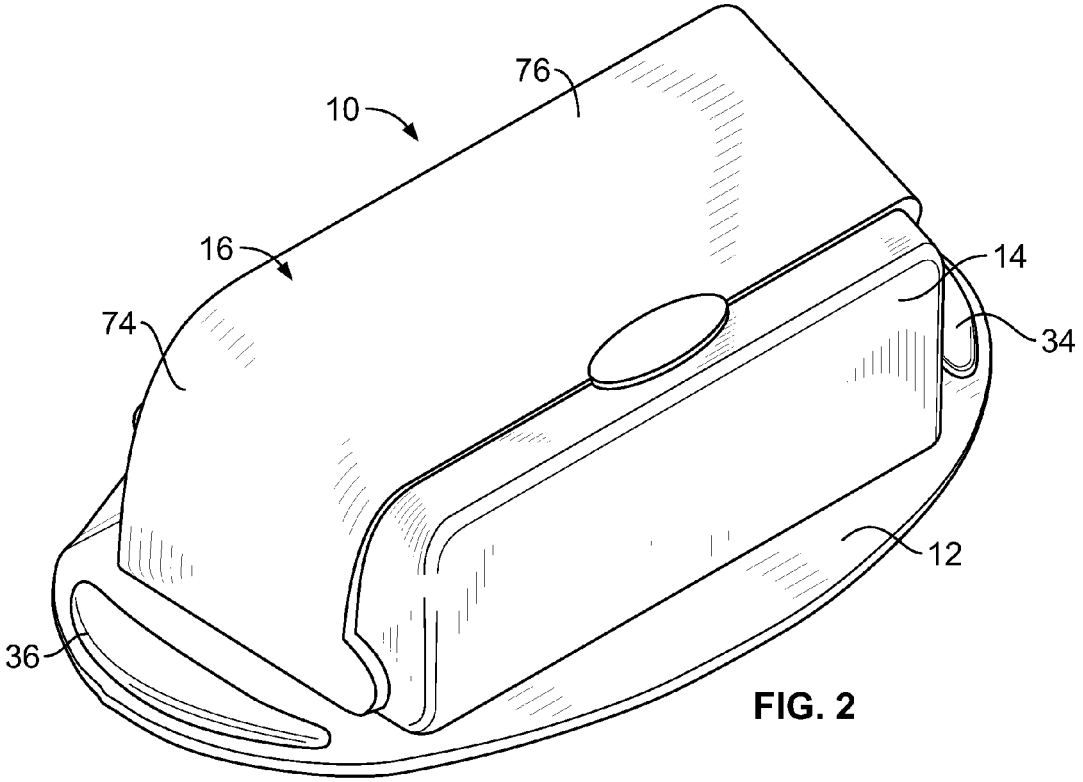
FIG. 2 is an isometric view of the rear and side of the closed butter dish shown in FIG. 1.
Figure 3:
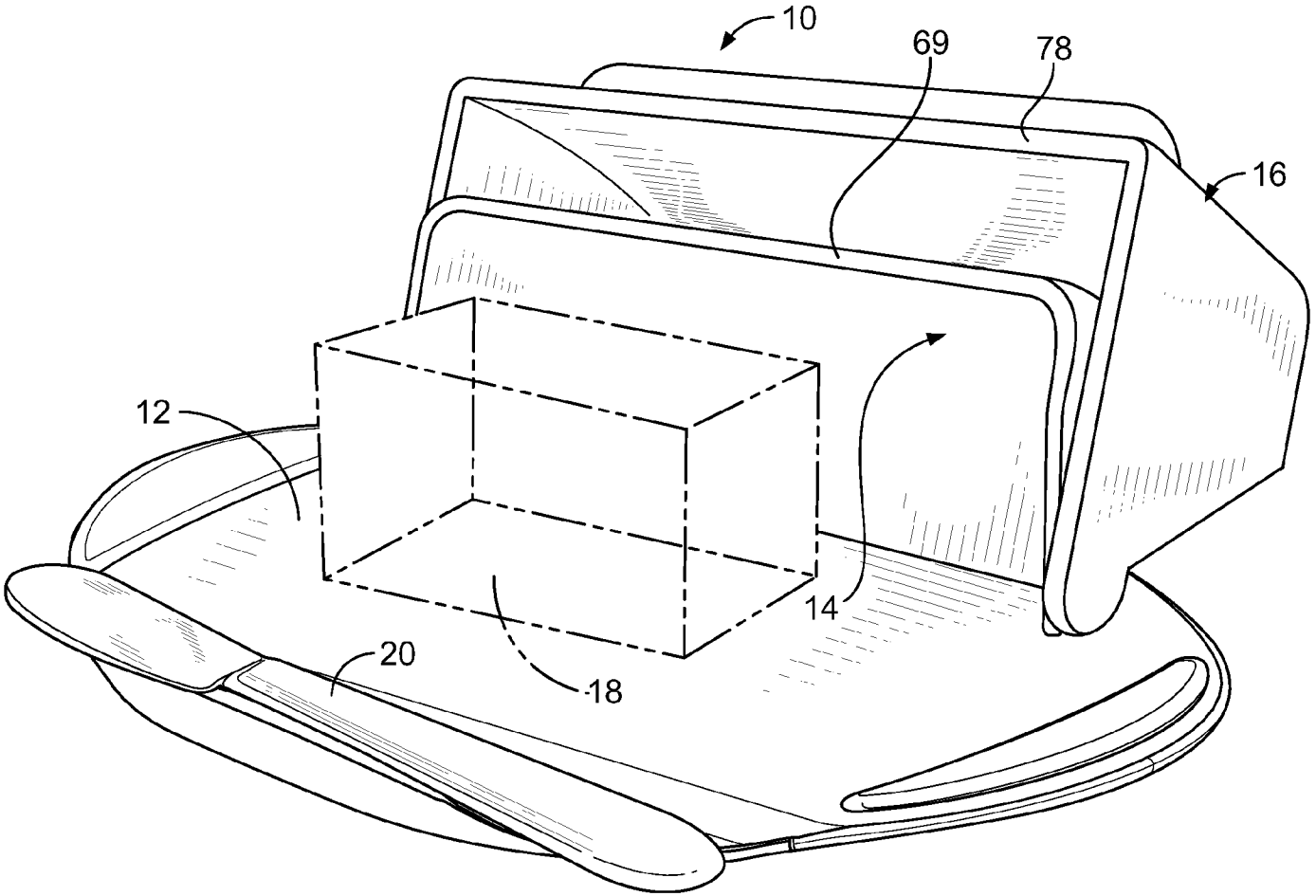
FIG. 3 is an isometric view of the butter dish shown in FIGS. 1 and 2, but in an opened position and illustrating a block of butter and a butter spreader.
Figure 9:
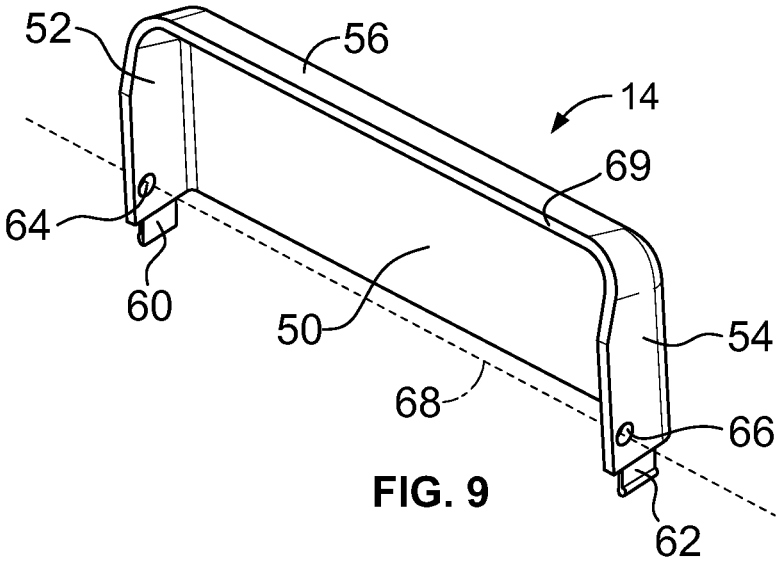
FIG. 9 is an isometric view of a rear wall of the butter dish shown in FIGS. 1-4.
Figure 10:
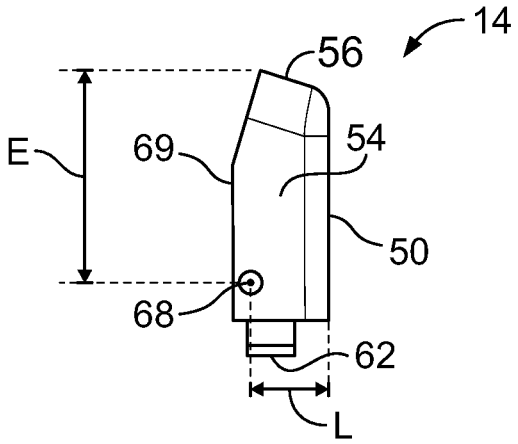
FIG. 10 is a side elevation view of the rear wall shown in FIG. 9.
Figure 11:
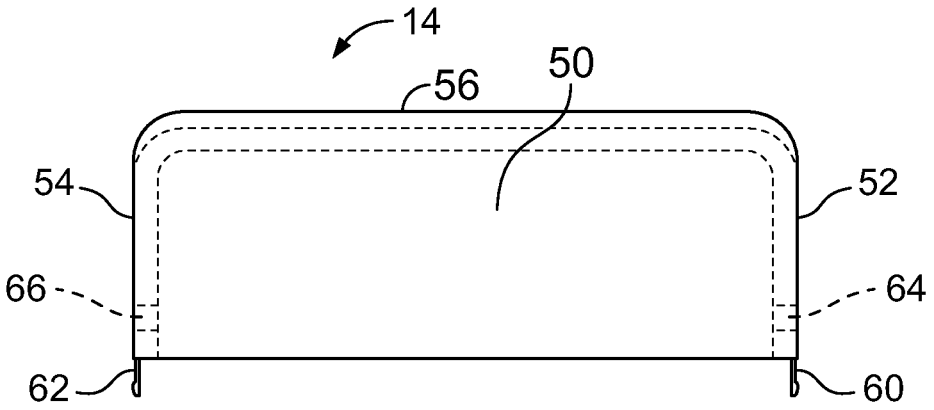
FIG. 11 is a rear elevation view of the rear wall shown in FIGS. 9 and 10.

Referring now to FIGS. 9-11, the rear wall 14 is shown in more detail. The rear wall 14 includes a rear panel 50 mounted to be generally vertical relative to the generally horizontal top surface 22 of the base 12, two short side panels 52, 54 and a short upper panel 56. The side panels 52, 54 are generally perpendicular to the rear panel 50. Connected to each side panel 52, 54 is an attachment leg 60, 62 which are dimensioned to be received by the slots 30, 32 located near the rear end 46 of the base 12, such that the rear wall 14 is permanently affixed to the base 12. Each side panel 52, 54 also includes a lower opening 64, 66 for defining an axis of rotation 68, FIGS. 9 and 13, in conjunction with the lid 16. The rotational axis 68 is positioned above the top surface 22 and near the rear end 46 of the base 12. The side and upper panels 52, 54, 56 form a forward facing edge 69. The rear wall 14 cooperates with the lid 16 to form an enclosure for the butter 18 when the butter dish 10 is closed as shown in FIGS. 1 and 2. When the butter dish 10 is opened, the rear wall 14 and the openings 64, 66 are located in a predetermined manner on the base 12 to provide a wide and deep space to enable a user to manipulate a butter spreader without unduly smearing butter on the lid, on the base or on the rear wall, and yet, the butter dish 10 is not overly large.

In the alternative, the rear wall may assume a somewhat different shape and may be formed, if the butter dish material is molded plastic, integral with the base.

The stylish lid 16, as seen in FIGS. 1-3, and 12-14, includes a front panel 70, left and right side panels 72, 74 and an upper panel 76, which blend smoothly with each other. The side panels 72, 74 are generally perpendicular to the front panel 70. The front and side panels 70, 72, 74 form a lower planar rim or edge 78, FIG. 14, that mates with the planar region 24, FIG. 5, of the top surface 22 of the base 12 when the lid is in the closed position. The top surface 22 of the base and the front, top and side panels 70, 72, 74, 76 of the lid cover the butter on the planar region 24 of the base from five sides. The two side panels 72, 74 and the upper panel 76 form a rear rim, border or edge 80, FIG. 13, that defines a rear opening 82 of the lid 16. The rear edge 80 mates with the rear wall 14 to close and cover the butter from a sixth side as shown in FIG. 2. Thus, a full enclosure is formed around the butter 18 when the butter dish 10 is in the closed position.

Figure 13:
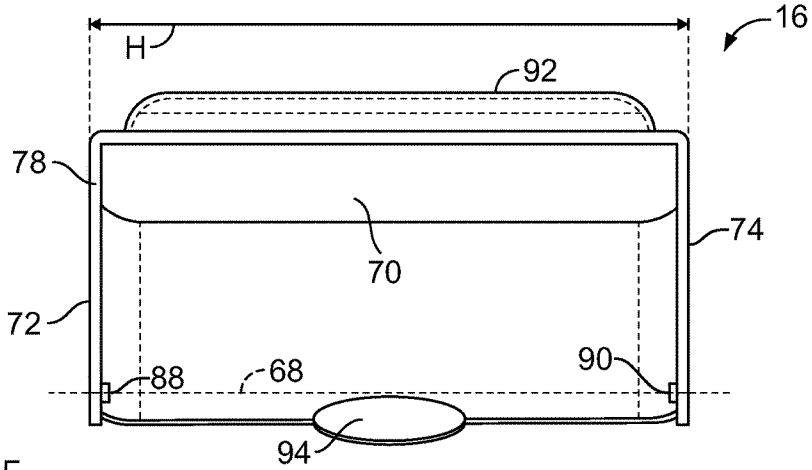
FIG. 13 is a bottom plan view of the lid shown in FIG. 12.
Figure 14:
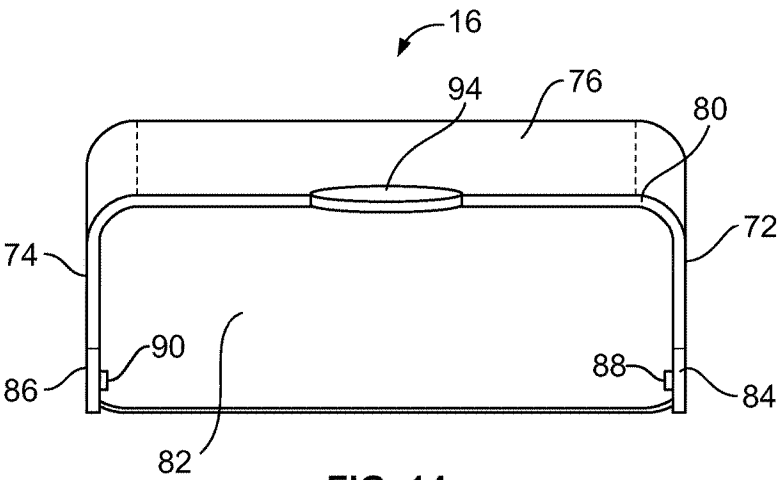
FIG. 14 is a rear elevation view of the lid shown in FIGS. 12 and 13.
Figure 12:
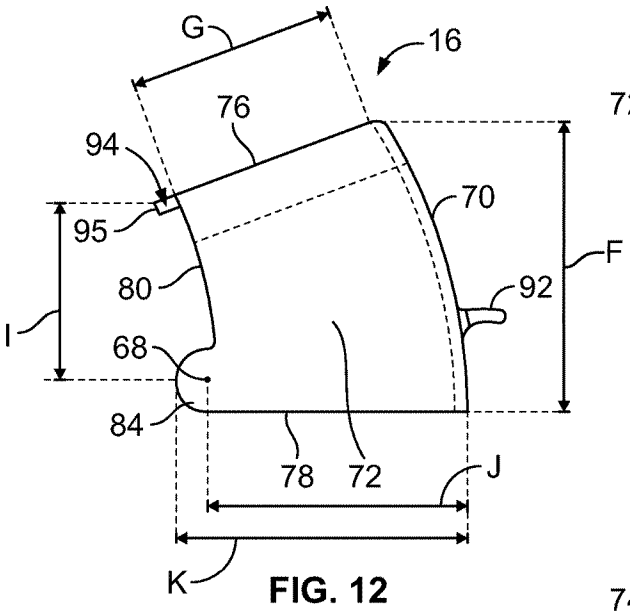
FIG. 12 is a side elevation view of a lid of the butter dish shown in FIGS. 1-4.

Extending from the rear edge 80 at each side panel 72, 74 are tabs 84, 86, and the tabs extend the lower edge 78 rearward as clearly shown in FIG. 12. Extending laterally from the tab 84, FIGS. 13 and 14, is a short shaft 88, and extending laterally from the tab 86 is a short shaft 90. The shafts 88, 90 are received by the openings 64, 66, FIG. 9, in the side panels 52, 54 of the rear wall 14 and complete the rotational axis 68 to enable the lid 16 to rotate between the closed position shown in FIGS. 1 and 2, and the opened position shown in FIG. 3.

The front panel 70 is smoothly curved upward from the lower edge 78, and the upper panel 76 is positioned obliquely or slanted downward from the top of the front panel 70 to the rear edge 80. Extending outward from the front panel 70 is a handle 92 to facilitate opening and closing the lid. Extending rearward from the upper panel 76 and the rear edge 80 is a bumper 94 with an end portion 95. The bumper is preferably formed of resilient material and functions to limit the rotation of the lid and cushion contact of the lid with the support surface 42, FIG. 4. The lid is constructed and dimensioned, along with the base 12 and the rear wall 14, such that the front panel 70 of the lid and the rear edge 80 are curved and generally parallel to one another, and the rear edge 80 and the lower edge 78 rotate about identical or near identical angles.

In the alternative, the rear wall may mount shafts for receipt by openings in the lid, or fastener elements may be placed in aligned openings in both the rear wall and the lid. The shape of the lid may be more rounded or less so, and other products besides butter may be stored in the butter dish.

In operation of the butter dish 10, a user places the butter dish on a conveniently located countertop or table, near a toaster for example, so that toast may be easily buttered. A stick or block of butter 18 is placed on the planar region 24 of the top surface 22 of the base 12 and the lid 16 is closed as shown in FIGS. 1 and 2. The base 12, the rear wall 14 and the mating lid 16 form an enclosure for the butter to enable the butter to remain out on a countertop or table for a week or more. It has been found that daily refrigeration of butter is not necessary and may, in many cases, remain at room temperature until completely consumed. Storing the butter in typical household ambient conditions enables the butter within a short time to reach room temperature and be relatively soft to make spreading of the butter quite easy. Because the lid 16 opens beyond 90° a user will have little trouble handling the butter spreader 20 and avoiding the lower edge 78 of the lid 16 or other parts of the butter dish 10. If butter does not get smeared on the lower edge 78, the bottom edge of the lid will not stick to the top surface 22 of the base 12. Any excess butter remaining on the knife may be removed by wiping the knife against the front edge 69, FIG. 9, of the rear wall 14.

The preferred dimensions of the butter dish are as follows: the major dimension A, FIG. 5, of the oval base 12 is about 8.5 inches, and the minor dimension B is about 5.25 inches. The width C, FIG. 6, of the recess 26 in the base 12 is about 0.75 inches and the distance D from the recess 26 to the rear end 46 of the base 12 is about 4.15 inches. The height E, FIG. 10, from the rotational axis 68 to the top of the rear wall is about 1.8 inches. The height F, FIG. 12, of the lid 16 from the lower edge 78 is about 2.8 inches, the depth G of the upper panel 76 of the lid 16 is about 2.2 inches, the width H, FIG. 13 of the lid 16 is about 5.85 inches, the height I, FIG. 12, from the rotation axis 68 to the bumper 94 is about 1.9 inches, the distance J from the front panel 70 of the lid 16 to the rotational axis 68 is about 2.55 inches, the distance K from the front panel 70 of the lid to the end of the tab 84 is about 2.85 inches, the distance L, FIG. 10, from the rotational axis 68 to the rear panel 50 of the rear wall 14 is about 0.68 inches, and the distance M, FIG. 4, between the rotational axis 68 to the rear 46 of the base 12 is about 1.5 inches.

(The dimensions provided above are somewhat approximate even though some dimensions extend to two decimal places. This approximation is because the intersections of connecting panels are difficult to discern when curved corners are used as here, unlike for example, a sharp crease in a folded piece of paper. In addition, different materials will form intersections somewhat differently and different wall thicknesses will also affect the geometry of the intersections.) It is noted that the butter dish may be formed of any suitable plastic, metal, ceramic or porcelain, and may even be formed of coated paper.

Figure 4:
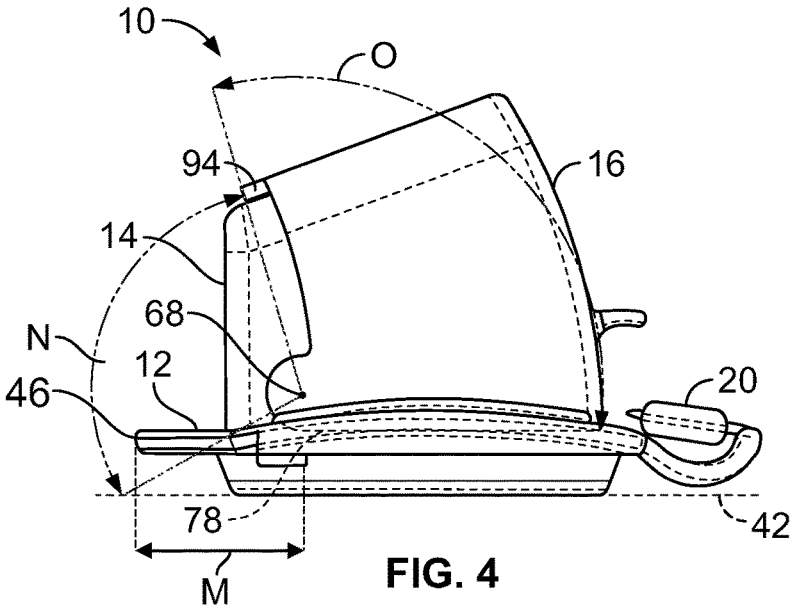
FIG. 4 is a reduced side elevation view of the closed butter dish shown in FIGS. 1 and 2, but including a butter spreader.
Figure 5:
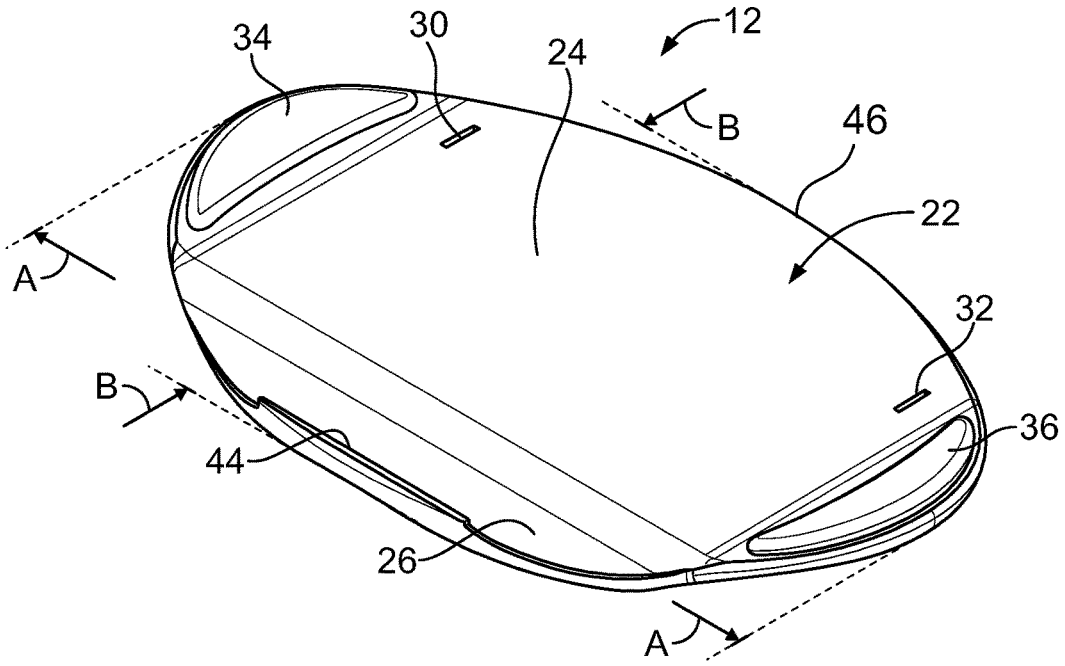
FIG. 5 is an isometric view of a base of the butter dish shown in FIGS. 1-4.
Figure 6:
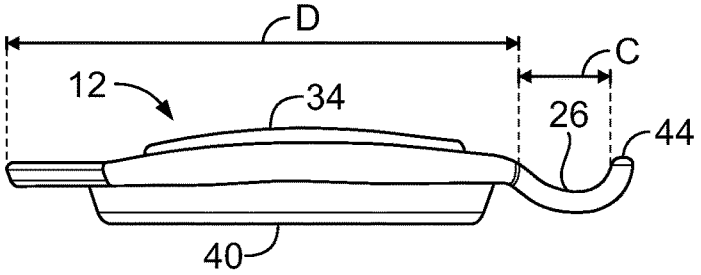
FIG. 6 is a side elevation view of the base shown in FIG. 5.
Figure 7:
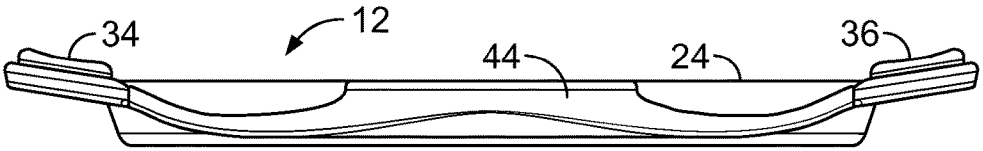
FIG. 7 is a front elevation view of the base shown in FIGS. 5 and 6.
Figure 8:
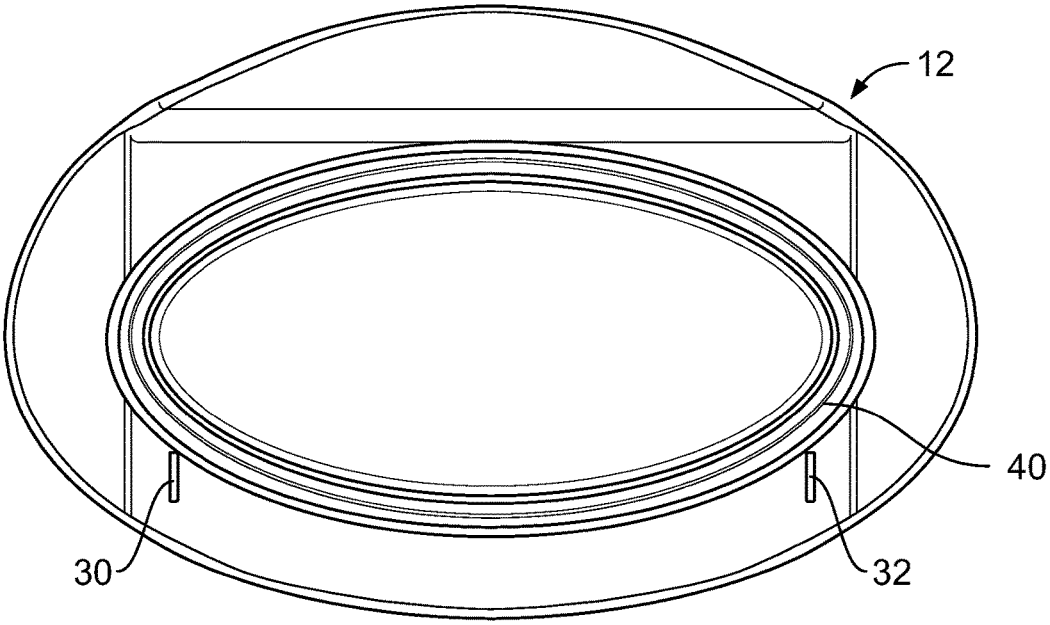
FIG. 8 is a bottom plan view of the base shown in FIGS. 5-7.

Because of the dimensions of the structures set forth above, the angle of rotation N, FIG. 4, of the bumper 94 from the first position of the lid 16 shown in FIG. 4, to the second position of the lid where the bumper contacts the support surface 42 is about 110°, and is generally identical with the angle of rotation O of the lower edge 78 of the lid relative to the planar region 24 of the top surface 22 of the base 12 when the lid moves from the first position to the second position thereby providing for a larger opening to enable a user easy access to the butter 18. It is to be understood that altering the dimension or structure of the bumper 94 itself or relative to the rotational axis 68, and/or the dimension from the rotational axis 68 to the bottom rim 40 of the base 12 (roughly the same distance as to the support surface 42), or the depth dimension of the upper panel 76 of the lid, will alter the angle of rotation of the bumper and of the bottom edge of the lid. Therefore, different sized butter blocks or sticks may be easily accommodated by simple changes in those dimensions and still result in a wide 110° opening. Or in the alternative, the dimensions and structures may be changed should a larger opening be desired.

The plastic material for the butter dish 10 may be ABS, polycarbonate, a blend of ABS and polycarbonate or polypropylene. Soft components, such as the bumper 94, the side pads 34, 36 and the handle 92, may be formed from a thermoplastic elastomer that may be over-molded or molded separately and attached by stretching a part and mechanically interlocking the part with another part. According to Wikipedia butter sticks are commonly produced in two different configurations: the dominant shape east of the Rocky Mountains is the "Elgin" or Eastern-pack shape and is about 4.8 inches long and about 1.3 inches wide; west of the Rocky Mountains a different shape developed and it is referred to as the Western-pack, and these are about 3.1 inches long and about 1.5 inches wide.

It is noted that throughout this detailed description, words such as "upper," "lower," "front," "rear," "top" and "bottom," as well as similar positional terms, refer to portions or elements of the butter dish as they are viewed in the drawings relative to other portions, or in relationship to the positions of the apparatus as it will typically be deployed and moved during use, or to movements of elements based on the configurations illustrated.

Figure 15:
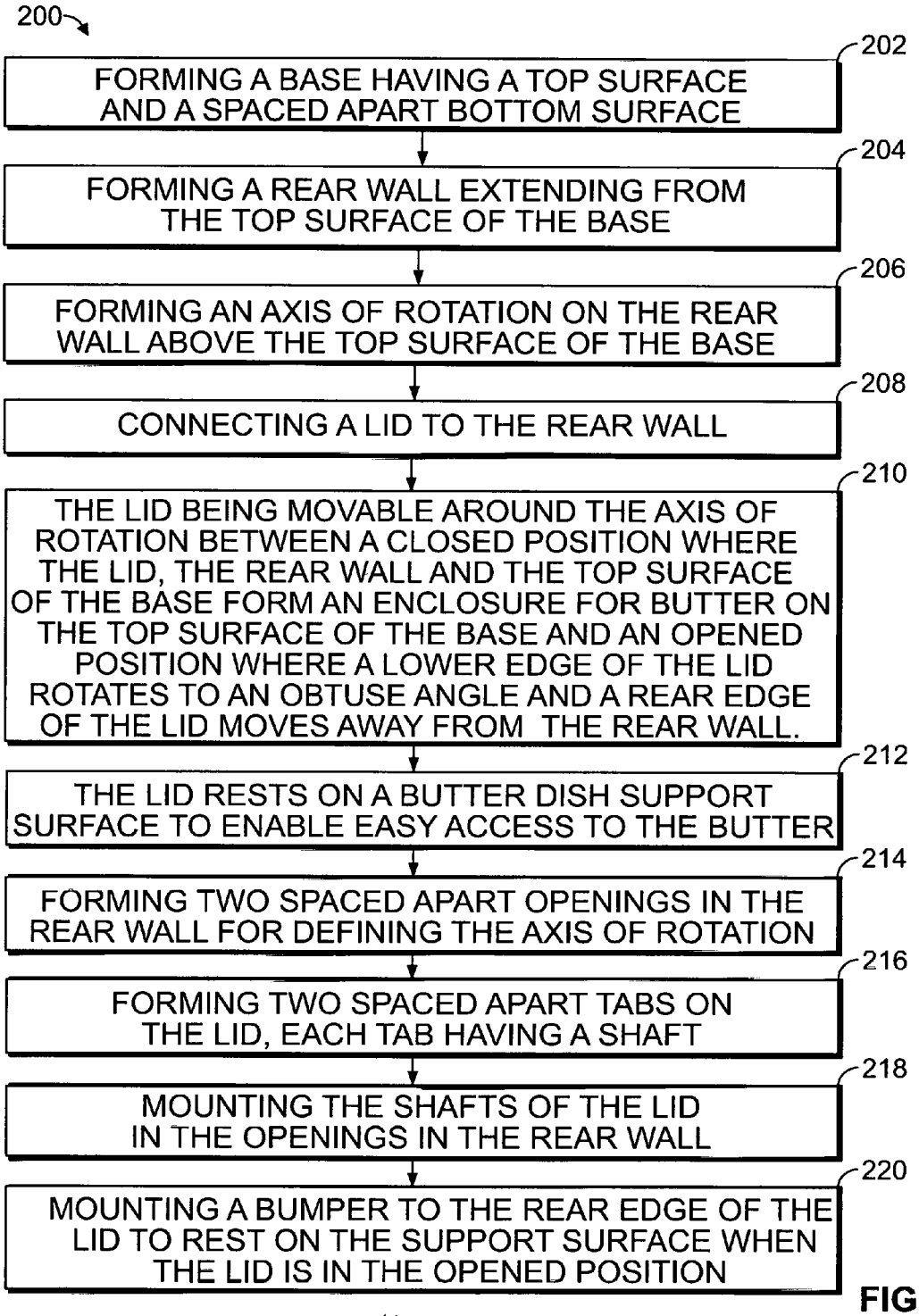
FIG. 15 is a flow diagram of a method for making the butter dish shown in FIGS. 1-4.

The present invention also includes a method 200, FIG. 15, for making a butter dish including the steps of forming a base having a top surface and a spaced apart bottom surface 202, forming a rear wall extending from the top surface of the base 204, forming an axis of rotation on the rear wall above the top surface of the base 206, and connecting a lid to the rear wall 208, the lid being movable around the axis of rotation between a closed position where the lid, the rear wall and the top surface of the base form an enclosure for butter on the top surface of the base and an opened position where a lower edge of the lid rotates to an obtuse angle and a rear edge of the lid moves away from the rear wall 210 wherein the lid rests on a butter dish support surface to enable easy access to the butter 212. The method may also include the steps of forming two spaced apart openings in the rear wall for defining the axis of rotation 214, forming two spaced apart tabs on the lid, each tab having a shaft 216, mounting the shafts of the lid in the openings in the rear wall 218, and mounting a bumper to the rear edge of the lid to rest on the support surface when the lid is in the opened position 220.

The butter dish 10 provides for a wide opening to ease access to the butter and prevent inadvertent smearing of the butter on the butter dish lid. The butter dish is also structured and dimensioned to easily alter the extent of the opening and/or adjust for different size butter sticks or blocks. The butter dish described in detail above is structurally robust but simply constructed, inexpensive to manufacture, compact and adapted to contain butter or other products of different dimensions.

From the foregoing, it can be seen that there has been provided features for an improved butter dish apparatus and a description of a method for making the butter dish. While a particular embodiment of the present invention has been shown and described in detail, it will be obvious to those skilled in the art that changes and modifications may be made, some of which having already been suggested above, without departing from the invention in its broader aspects. Therefore, the aim is to cover all such changes and modifications as fall within the true spirit and scope of the invention. The matters set forth in the foregoing description and accompanying drawings are offered by way of illustration only and not as limitation. The actual scope of the invention is to be defined by the subsequent claims when viewed in their proper perspective based on the prior art.

What is claimed is:

1. A butter dish with a rotatable lid comprising:

a base having a bottom surface for supporting the butter dish on a support surface and a top planar surface spaced away from the bottom surface for supporting butter;

a rear wall connected to the base for forming part of an enclosure and defining a rotational axis, the rotational axis being spaced from the top surface of the base and located near a rear of the base; and a lid connected to the rear wall and forming another part of the enclosure over the base and over any butter on the top planar surface of the base, the lid having a lower edge and a rear opening bordered by a rear edge, and the lid being constructed and dimensioned to be rotatable around the rotational axis between a first position where the rear edge of the lid cooperates with the rear wall to close the enclosure and the lower edge of the lid is supported by the top planar surface of the base, and a second position where the rear and lower edges of the lid have rotated to about a same obtuse angle relative to the top planar surface of the base.

2. The butter dish of claim 1, wherein:

the lid includes a bumper connected to the rear edge of the lid; and the bumper defines the rotated angle from the first position to the second position of the lid.

3. The butter dish of claim 1, wherein:

the lid includes a front panel, two side panels and a tab extending from each side panel, the tabs forming with the rear wall the rotational axis.

4. The butter dish of claim 1, wherein:

the rear wall includes a rear panel, two side panels and an upper panel.

5. The butter dish of claim 1, wherein:

the lid includes an upper panel adjacent and generally parallel to the upper panel of the rear wall when the lid is in the first position.

6. The butter dish of claim 1, wherein:

the rear wall includes openings for receiving shafts connected to the lid; and the openings of the rear wall and the shafts of the lid define the rotational axis.

7. The butter dish of claim 1, wherein:

the lid includes an upper panel and a front panel which meet at about 90°; and the upper panel of the lid extends obliquely relative to the lower edge.

8. The butter dish of claim 1, wherein:

the lid includes a front panel; and the rear edge and the front panel of the lid are curved and generally parallel to one another.

9. The butter dish of claim 1, wherein:

the base extends beyond the lid when in the closed position and includes a recessed region.

10. The butter dish of claim 1, wherein:

the lid includes a handle extending from a front panel of the lid.

11. The butter dish of claim 10, wherein:

the lid includes a bumper connected to the rear edge;

the lid includes the front panel, two side panels and a tab extending from each side panel and forming with the rear wall the rotational axis; and the rear wall includes a rear panel, two side panels and an upper panel.

12. The butter dish of claim 11, wherein:

the lid includes an upper panel generally adjacent and parallel to the upper panel of the rear wall;

the rear wall includes openings for receiving shafts connected to the lid; and the upper panel and the front panel of the lid meet at about 90° and the upper panel of the lid extends obliquely relative to the lower edge of the lid.

13. The butter dish of claims 12, wherein:

the front panel and the rear edge of the lid are curved and are generally parallel to one another; and the base extends beyond the lid when in the closed position and includes a recessed region.

14. A butter dish with a rotatable lid comprising:

a base having a bottom surface for supporting the butter dish on a support surface and a top surface spaced away from the bottom surface, the top surface having a planar region for supporting butter and a recessed region for supporting a butter spreader;

a rear wall mounted to the base located near the rear of the base, the rear wall having a back panel extending at a generally perpendicular angle from the base, two side panels extending forward at a generally perpendicular angle from the back panel and having two openings for defining a rotational axis, the rotational axis being spaced from the top surface of the base and located near to the rear of the base; and a lid mounted to the two side panels of the rear wall and forming with the rear wall an enclosure over the base and over any butter on the planar region of the top surface of the base, the lid having a front panel, two side panels and an upper panel with a rear bumper, the front panel and the two side panels forming a lower edge for contacting the planar region of the top surface of the base and the two side panels and the top panel with the bumper forming a rear opening bordered by a rear edge, wherein the lid is rotatable around the rotational axis between a first position where the lower edge of the lid is supported by the planar region of the top surface of the base and a second position where the lower edge of the lid is disposed at an obtuse angle relative to the planar surface of the top surface of the base, the lid being dimensioned and structured such that the rotational movement of the bumper between the first and second positions of the lid is generally identical to the rotational movement of the lower edge of the lid between the first and second positions of the lid.

15. The butter dish of claim 14, wherein:

the angle of rotation of the bumper between the first and second positions of the lid is about 110°.

16. The butter dish of claim 15, wherein:

the upper panel of the lid is adjacent and generally parallel to an upper panel of the rear wall.

17. The butter dish of claim 16, wherein:

the lid includes two shafts that are received by the openings in the rear wall;

the front panel and rear edge of the lid are curved and generally parallel to one another.

18. A method for making a butter dish comprising the steps of:

forming a base having a top surface and a spaced apart bottom surface;

forming a rear wall extending from the top surface of the base;

forming an axis of rotation on the rear wall above the top surface of the base and near a rear of the base; and connecting a lid to the rear wall, the lid being movable around the axis of rotation between a closed position where the lid, the rear wall and the top surface of the base form an enclosure for butter on the top surface of the base and an opened position where a lower edge of the lid rotates to an obtuse angle and a rear edge of the lid moves away from the rear wall wherein the lid rests on a butter dish support surface to enable easy access to the butter.

19. The method of claim 18, including the steps of:

forming two spaced apart openings in the rear wall for defining the axis of rotation;

forming two spaced apart tabs on the lid, each tab having a shaft; and mounting the shafts of the lid in the openings in the rear wall.

20. The method of claim 19, including the step of:

mounting a bumper to the rear edge of the lid; and resting the bumper on the support surface when the lid is in the opened position.

* * * * *